United States Patent [19]

Kloosterman

[11] 4,393,587

[45] Jul. 19, 1983

[54] SPRING SHIELDED SAFETY KNIFE

[76] Inventor: William A. Kloosterman, 6553 Hearne Rd. - 1107, Cincinnati, Ohio 45211

[21] Appl. No.: 256,775

[22] Filed: Apr. 23, 1981

[51] Int. Cl.[3] ..... B26B 1/08

[52] U.S. Cl. ..... 30/162; 30/293

[58] Field of Search ..... 30/162, 293, 2, 286, 30/294

[56] References Cited

U.S. PATENT DOCUMENTS 2,483,750 10/1949 Bratrud ..... 30/293 X 2,882,598 4/1959 Fidelman ..... 30/162 X 4,091,537 5/1978 Stevenson ..... 30/286

4,192,066 3/1980 Tucker ..... 30/162

*Primary Examiner*—Jimmy C. Peters

*Attorney, Agent, or Firm*—Harvey B. Jacobson

[57] ABSTRACT

A safe knife is provided by utilizing a spring operated blade guard which automatically covers the blade of the knife at such times when the knife is not in use. The blade guard includes a knife guide plate which serves to correctly position the knife blade for a cutting operation, and the blade guard is retractable into an outer shell or handle of the knife against the compression force of a spring when a cutting operation is undertaken by a user, so as to expose only so much of the blade as required to efficiently perform the cutting operation.

6 Claims, 7 Drawing Figures

SPRING SHIELDED SAFETY KNIFE

BACKGROUND OF THE INVENTION

1. Field of the Invention

The present invention relates generally to a knife and more particularly pertains to a knife wherein a blade guard is provided which automatically covers the blade when the knife is not being used.

2. Description of the Prior Art

It is generally recognized that replaceable blade knives are extremely dangerous due to the sharpness of the blades forming a part thereof. As an approach for lessening this danger, there have been a number of blade knives constructed which permit a manual retraction of the blade into handle portions of the knives when the knives are not in use. For example, U.S. Pat. No. 3,879,847, issued to Roll on Apr. 29, 1975, discloses a cutter having a forwardly and rearwardly displaceable blade. In this respect, a blade is provided in a blade slide, and a thumb actuated travel guide provided on the handle portion of the cutter permits the slide to be retracted into a hollow portion of the handle. Accordingly, the blade may be withdrawn into the handle along with the slide so as to conceal the same when not in use. Similarly, U.S. Pat. No. 4,103,421, issued to Quenot on Aug. 1, 1978, discloses a blade-holding cutting device which has a slidably mounted blade affixed thereto, such blade being positioned in a slider which may be manually caused to retract into the handle portion of the device.

While these particular constructions provided in the above-described patents eliminate some of the danger attendent with exposed blades, it can be appreciated that the manual operation required for retracting the blades is unsatisfactory in those situations where a knife slips during a cutting operation, thus resulting in an injury to a user. In other words, a large number of industrial accidents occur from employees cutting across a line of material, and the knife slips and accidentally cuts an employee. Obviously, in such a situation, the employee has little or no time to register the fact in his mind that the knife has slipped and that he should manually retract the blade before the same cuts his body.

Therefore, there still exists a need for safety guards utilizable with knives which will automatically and rapidly cover a blade in the event that the same should slip during a cutting operation, as well as automatically shield the blade when the knife is not in use. In this connection, the present invention substantially fulfills this need.

SUMMARY OF THE INVENTION

The general purpose of the present invention, which will be described subsequently in greater detail, is to provide a knife, having an automatic shield for covering its blade, that has all the advantages of similarly employed knives and has none of the above described disadvantages. To attain this, the present invention provides a knife which utilizes a replaceable blade affixed thereto and which further utilizes a spring biased slide member for normally covering the blade whereby the same presents no exposed cutting edges to a user. Specifically, the knife consists of an outer shell or handle having a blade shaft concentrically positioned relative thereto, such blade shaft having a blade removably fixedly secured on a free end thereof. Further, the slide member or inner slide is concentrically mounted within the outer shell and handle and about the blade shaft, and is spring biased through the use of a compression spring so that the same extends outwardly from the handle in a manner which completely covers the blade shaft and the blade attached thereto. The inner slide is further provided with a knife guide plate which is aligned at a 45° angle on a remote end thereof whereby when an operator places the guide plate on a material to be cut, a slight downward pressure on the handle results in the inner slide moving inwardly against the force of the compression spring into the hollow interior of the handle, thus exposing the cutting edge of the blade in a manner which permits the same to cut material as desired.

It is, therefore, an object of the present invention to provide a knife that has all the advantages of similarly employed prior art knives and none of the disadvantages.

It is another object of the present invention to provide a knife which may be easily and economically manufactured.

It is a further object of the present invention to provide a knife which utilizes an automatic guard means in conjunction therewith.

Still another object of the present invention is to provide a knife which substantially eliminates the danger of a user being cut during a use thereof.

Yet another object of the present invention is to provide a knife which utilizes a guide means for facilitating accurate cutting of material as desired.

Even another object of the present invention is to provide a knife which is of a reliable and durable construction.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
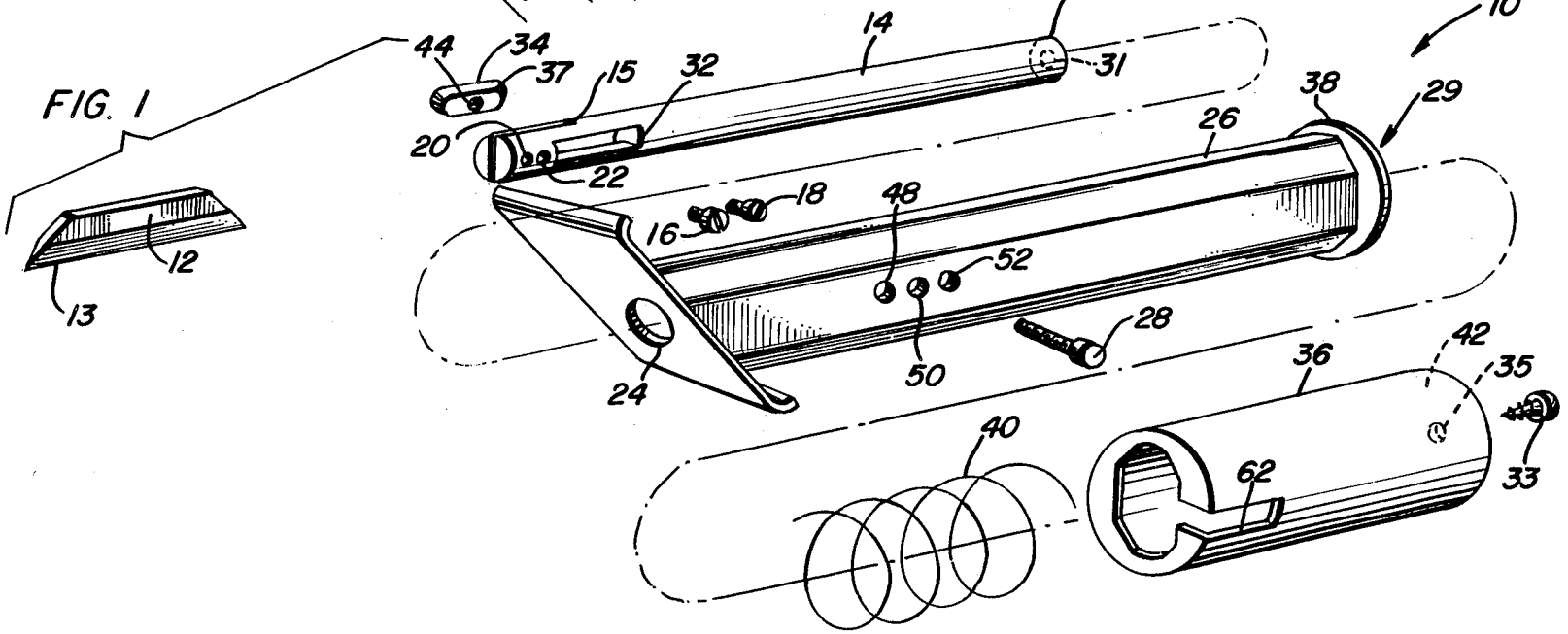
FIG. 1 is an exploded perspective view of the spring shielded safety knife forming the present invention and illustrating the various parts associated therewith.

Referring now to the drawings and in particular to FIG. 1 thereof, a spring shielded safety knife embodying the concepts and principles of the present invention and generally designated by the reference numeral 10 will be described in detail. Specifically, the knife 10 is shown in an exploded form to illustrate the various parts thereof. In this respect, it can be seen that the knife 10 includes a blade 12 having a sharp edge 13 and inclined end edges which is mountable to a blade shaft 14 within a blade receiving slot 15 through the use of a pair of blade mounting screws 16, 18, respectively engageable with screw receiving apertures 20, 22. In this connection, the apertures 20, 22 are threaded so that end portions of the screws 16, 18 may abut against the blade 12 thus to effectively retain the same within the slot 15 or the blade 12 may have aperatures in the center thereof receiving the anchoring screws or the blade may have a notch on its unsharpened edge to receive a clamp screw or other anchoring device. Further shown in FIG. 1 is the fact that the blade shaft 14 is longitudinally movable through an aperture 24 leading to an inner portion of an inner slide member 26. In this regard, the blade shaft 14 is positionable over its entire length through the inner slide member 26 whereby an end portion 27 of the blade shaft extends outwardly through an opening 39 (FIG. 2) positioned on a remote end 29 of the inner slide member. By the same token, the remote end 27 of the blade shaft 14 has a threaded aperture 31 contained therein and being engageable with a screw 33 which is also threadably securable through an aperture 35 contained in an outer shell member or handle 36. Further, a flat plate member 38, having the opening 39 directed therethrough, is fixedly secured to the remote end 29 of the inner slide member 26, such plate member serving as an abutment means for one end of a compression spring 40 while an end wall 42 of the outer shell member 36 serves as an opposed abutment means for the same spring. As can be appreciated, the plate member 38 can be formed as an integral part of the inner slide member 26, while the opening 39 can be constructed with a diameter equal to the inside diameter of the inner slide member.

Additionally, FIG. 1 illustrates the fact that the amount of movement of the inner slide member 26 relative to the blade shaft 14 can be controlled through the use of a travel slide 34 positionable within a through slot 32 contained on the blade shaft 14. In this regard, the through slot 32 has bevelled side edges and slide 34 is provided with bevelled edges 37 whereby the travel slide 34 is slidable within the slot but is incapable of being pulled therethrough due to the bevelled construction thereof. Further, the travel slide 34 is provided with a threaded aperture 44 designed for threadably receiving a screw 28. In this regard, the screw 28 is insertable through one of a plurality of apertures 48, 50, 52 and is then extensible through the slot 32 so as to threadably engage the aperture 44, thus to retain the travel slide 34 in a sliding abutting engagement with the slot 32. As will be subsequently described with reference to the further views of the drawings, the travel slide 34 in cooperation with the screw 28 serves to limit the amount of movement of the inner slide member 26 in a manner which regulates the depth of cut of the blade 12.

Figure 2:
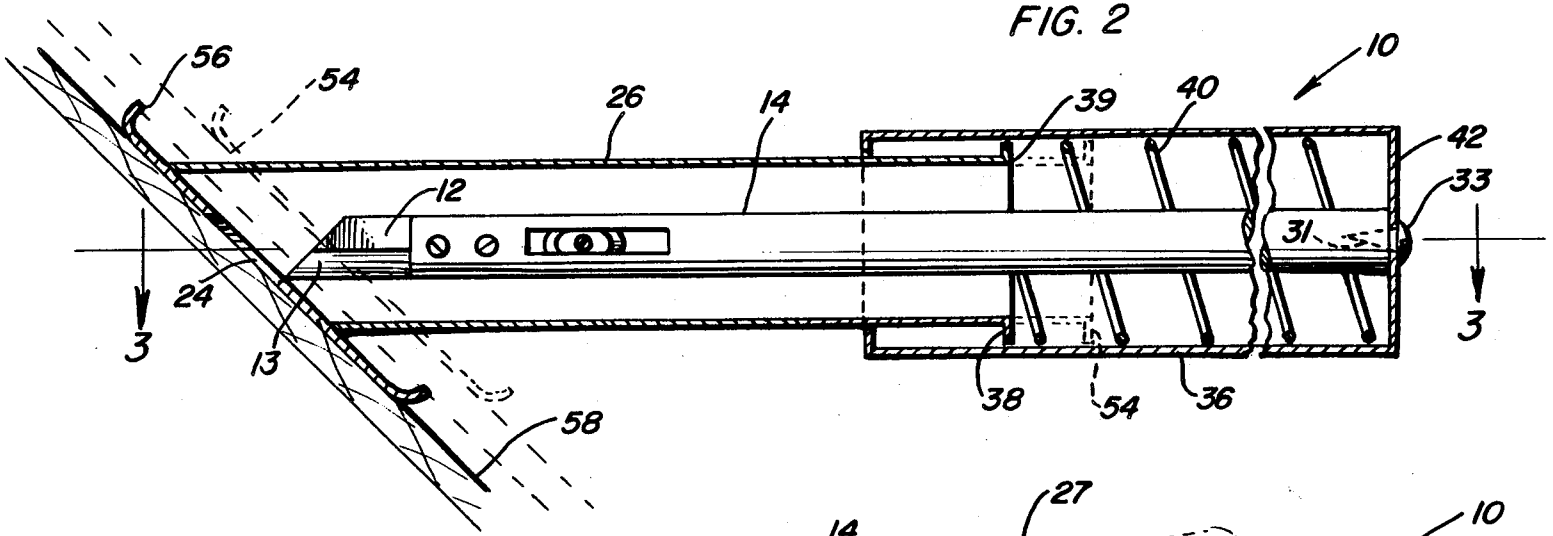
FIG. 2 is a longitudinal sectional view of the present invention illustrating the components thereof in their assembled form.

With reference then to FIG. 2 of the drawings, it can be seen that the knife 10 in its assembled form envisions having the blade shaft 14 fixedly secured to the end wall 42 of the outer shell member 36. This fixed securement is accomplished through the use of the aforedescribed screw 33 being threaded into the aperture 31 contained on an end portion 27 of the blade shaft or alternatively, the blade shaft and the handle 36 could be cast out of aluminum, or some similar material, in one integral piece whereby the use of the screw 31 and associated apertures would not be required. As such, the blade shaft 14 is fixed to the outer shell member 36, while the inner slide member 26 is illustrated as being slidably movable along the blade shaft 14 and within the interior portion of the outer shell member 36. In this respect, the compression spring 40 serves to keep the inner slide member 26 in an extended position whereby the same substantially covers the blade shaft 14 and the blade 12 fixedly secured thereto. By the same token, it can be appreciated that the inner slide member 26 may be pushed inwardly into the outer shell member 36 against the force of the compression spring 40, such as to a position 54, as shown in phantom lines, so as to expose the blade 12 for the purpose of performing a cutting operation. Similarly, once such a cutting operation has been completed, it can be seen that the compression spring 40 will again force the inner slide member 26 outwardly from the outer shell member 36 so as to again substantially cover the cutting edge of the blade 12 when the knife is no longer engaged with the material being cut.

As shown in both FIGS. 1 and 2, the inner slide member 26 is further provided with a knife guide plate 56 which is constructed as an integral part thereof and which serves to guide the movement of the knife 10 along the surface of a material 58 to be cut. Effectively then, it can be appreciated that the blade 12 is normally in a retracted position within the inner slide member 26 and, in response to a pressure upon the knife guide plate 56 as exerted by an operator pushing the knife down against the material 58 to be cut, the inner slide member will slide into the handle or outer shell member 36 so as to permit the blade 12 to come into a cutting engagement with the material.

Reference is next made to FIGS. 3–6 of the drawings wherein a discussion of the operation of the travel slide 34 will be provided. In this regard, it can be seen that the aforedescribed slot 32 extends completely through the blade shaft 14 so as to permit the shank of the screw 28 to move along the same. Specifically, the screw 28 is maintained in a fixed relationship with the inner slide member 26 by passing through one of the apertures 48, 50, 52, whereby movement of the inner slide member 26 into the interior of the outer shell member 36 against the force of the compression spring 40 results in a similar movement of the shank of the screw 28 and travel slide 34 along the slot 32. In this respect, it can be seen that the travel slide 34 has end portions 60 which will come into abutting relationship with an end 62 of the slot 32 thereby to limit any further movement of the inner slide member 26 with respect to shaft 14. As such, the screw 28 may be positioned in any one of the three apertures 48, 50, 52 to thereby vary the position of the travel slide 34 within the slot 32 and thus control the depth of cut which can be made with the blade 12.

Figure 7:
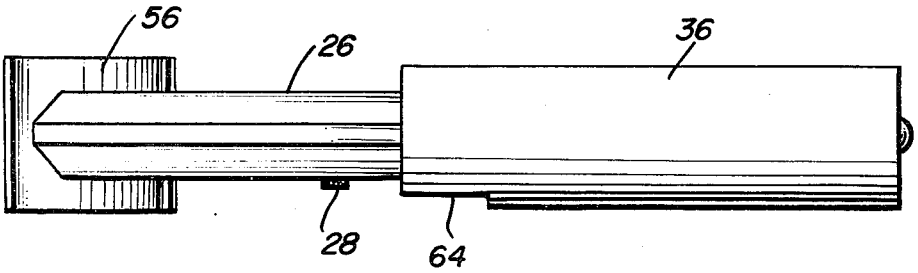
FIG. 7 is a top plan view of the present invention in its assembled form.
Figure 3:
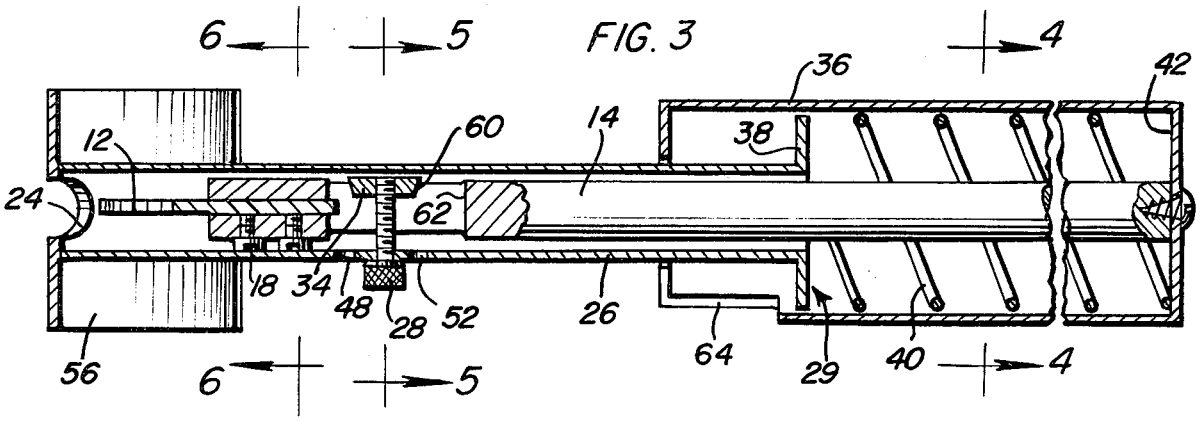
FIG. 3 is a longitudinal sectional view of the present invention taken generally along section line 3—3 of FIG. 2.
Figure 4:
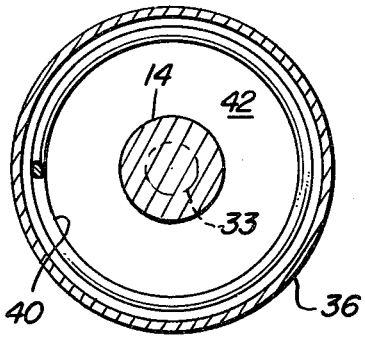
FIG. 4 is a transverse sectional view, on an enlarged scale, of the knife taken generally along section line 4—4 of FIG. 3.
Figure 5:
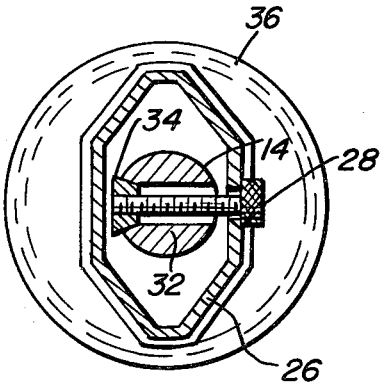
FIG. 5 is a transverse sectional view taken generally along section line 5—5 of FIG. 3.
Figure 6:
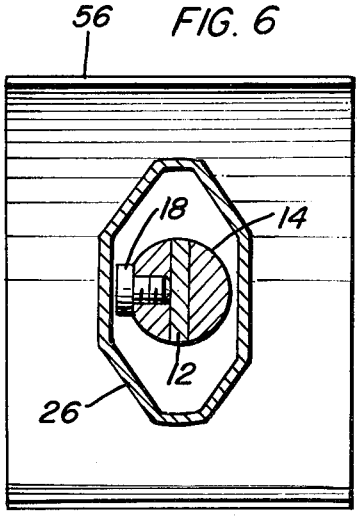
FIG. 6 is a transverse sectional view taken generally along section line 6—6 of FIG. 3.

FIG. 7 illustrates the symmetrical construction of the spring shielded safety knife 10 and the travel slide adjustment screw 28 which extends outwardly from the inner slide member 26 in a manner which permits adjustment of the blade travel depth without disassembly of the knife. A slot 64 is provided on the outer shell member 36 which enables movement of the head of the screw 28 into the outer shell member without a user of the knife having the same contact his hand.

In use then, it can be appreciated that the inner slide member 26 may be retracted into the outer shell member 36 against the force of the compression spring 40 by an operator, and a blade 12 may then be slipped into the slot 15 contained on the blade shaft 14. Once the proper positioning of the blade 12 is achieved, the respective blade mounting screws 16, 18 may be tightened against the blade 12 in the manner illustrated in FIG. 6 of the drawings, and the inner slide member 26 may then be allowed to slide outwardly over the blade shaft so as to shield the blade in the manner illustrated in FIG. 2. An operator may then selectively position the travel slide screw 28 through one of a plurality of apertures 48, 50, 52 so as to regulate the depth of cut of the blade 12 into a material 58 by limiting the movement of the inner slide member 26 into the outer shell member 36. Accordingly, an operator need only to grasp the outer shell member 36 and position the knife 10 against the material 58 in the manner illustrated in FIG. 2, and he may then press downwardly on the knife in a manner whereby the knife guide plate 56 is in a flat abutting relationship with the material to be cut. This downward force results in the inner slide member 26 moving against the force of the compression spring 40 into the interior of the outer shell member 36, thus exposing the blade 12 to the depth allowed by the adjustment of the travel slide 34.

With respect to the above description, it should be realized that the optimum dimensional relationships for the parts of the invention are deemed readily apparent and obvious to one skilled in the art, and all equivalent relationships to those illustrated in the drawings and described in the specification are intended to be encompassed by the present invention.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A spring shielded safety knife, said knife including handle means for permitting a user to operably grip said knife, said handle means having a hollow interior portion, blade cutting means fixedly secured to said handle means and extending outwardly therefrom, blade shield means normally positionable over said blade cutting means and being slidably retractable into said hollow interior portion of said handle means, spring means contained in said hollow interior portion biasing said blade shield means into blade shielding position, said blade shield means being retained in position over said blade cutting means by a compression force provided by said spring means, said blade cutting means being detachably securable to a longitudinally extending blade shaft, said blade shaft being in concentric alignment with said hollow interior portion of said handle means and being fixedly secured to a remote end of said handle means, said blade shaft having a travel slide means operably associated therewith, said travel slide means serving to regulate a depth of cut of said blade cutting means by limiting a movement of said blade shield means into said hollow interior portion of said handle means, said travel slide means including a travel slide operably positionable in a slot on said blade shaft and further including a screw means threadably securable thereto, said screw means passing through said slot means in said blade shaft and being securable to an aperture contained on said blade shield means.

2. The spring shielded safety knife as defined in claim 1, wherein a plurality of apertures are provided in said blade shield means so as to facilitate a selective positioning of said travel slide in said slot, thus to provide for a plurality of different cutting depths of said blade cutting means.

3. The spring shielded safety knife as defined in claim 1, wherein said blade shield means is provided with a blade guide plate, said blade guide plate being positioned on one end of said shield means and being abuttable against a material to be cut so as to facilitate such cutting by a user of said knife.

4. A spring shielded safety knife, said knife comprising:

handle means for permitting a user to operably grip said knife, said handle means having a hollow interior portion;

blade shaft means concentrically positionable within said hollow interior portion of said handle means and being fixedly secured to a remote end of said handle means;

blade means fixedly securable to an end of said blade shaft means extending outwardly from said handle means;

inner slide means normally positionable over said blade means so as to prevent a cutting injury to a user of said knife, said inner slide means being retractable into said hollow interior portion of said handle means against a compression force provided by a spring means operably positioned in said hollow interior portion, said spring means serving to hold said inner slide means over said blade means when said knife is not being used by a user;

travel slide means operably associated with said blade shaft means and said inner slide means, said travel slide means including a travel slide positionable in a slot formed through said blade shaft means, said travel slide means further including a screw insertable through one of a plurality of apertures extending through said inner slide means, said screw being threadedably securable to said travel slide, said travel slide means serving to regulate a depth of cut provided by said knife by limiting a movement of said inner slide means into said hollow interior portion of said handle means, thereby limiting the extent that said blade means extends outwardly from said inner slide means; and knife guide plate means fixedly secured to an end of said inner slide means from which said blade means extends during an operation of said knife by a user, said knife guide plate means being directly abuttable against a material to be cut and serving to facilitate a cutting of such material by said user.

5. The knife as defined in claim 4 wherein said blade means includes a trapezoidal blade having one sharpened edge and converging end edges to provide a reversible blade with pointed corner portions where the sharpened edge joins with the end edges.

6. A spring shielded safety knife, said knife including handle means for permitting a user to operably grip said knife, said handle means having a hollow interior portion, blade cutting means fixedly secured to said handle means and extending outwardly therefrom, blade shield means normally positionable over said blade cutting means and being slidably retractable into said hollow interior portion of said handle means, spring means contained in said hollow interior portion biasing said blade shield means into blade shielding position, said blade cutting means being detachably securable to a longitudinally extending blade shaft, said blade shaft being in concentric alignment with said hollow interior portion of said handle means and being fixedly secured to a remote end of said handle means, said blade shaft having a travel slide means operably associated therewith, said travel slide means serving to regulate a depth of cut of said blade cutting means by limiting movement of said blade shield means into said hollow interior portion of said handle means, said travel slide means including a travel slide operably positionable in a slot on said blade shaft and further including a screw means threadably securable thereto, said screw means passing through said slot means in said blade shaft and being securable to an aperture contained on said blade shield means.

* * * * *